US010077898B2

(12) United States Patent
Gravel

(10) Patent No.: US 10,077,898 B2
(45) **Date of Patent: *Sep. 18, 2018**

(54) COMBUSTION ENGINE FOR BURNING A FUEL MIXTURE OF WATER AND ALCOHOL

(71) Applicant: International Clean Energy Solutions, Ltd., Basseterre (KN)

(72) Inventor: Marco Gravel, St-Constant (CA)

(73) Assignee: International Clean Energy Solutions, Ltd., Frigate Bay (KN)

( * ) Notice: Subject to any disclaimer, the term of this patent is extended or adjusted under 35 U.S.C. 154(b) by 150 days.

This patent is subject to a terminal disclaimer.

(21) Appl. No.: 15/335,159

(22) Filed: Oct. 26, 2016

(65) Prior Publication Data

US 2017/0045220 A1 Feb. 16, 2017

Related U.S. Application Data

(63) Continuation of application No. 14/043,011, filed on Oct. 1, 2013, now Pat. No. 9,506,656.

(51) Int. Cl.

| | |
|---|---|
| ***F24C 5/20*** | (2006.01) |
| ***F23C 7/00*** | (2006.01) |
| ***F23D 5/04*** | (2006.01) |
| ***F24C 5/12*** | (2006.01) |

(Continued)

(52) U.S. Cl.

CPC ..... *F23C 7/002* (2013.01); *F23D 5/04* (2013.01); *F23D 5/045* (2013.01); *F23K 5/10* (2013.01); *F24C 5/12* (2013.01); *F24C 5/20* (2013.01)

(58) Field of Classification Search

CPC ..... F24C 5/12; F24C 5/20; F24C 5/18; F24C 5/04; F24C 5/045; F24C 1/00; F24C 15/00; F24C 15/10; F24C 15/20; F23C 7/002; F23C 7/008; F23C 2700/023; F23D 5/123;

(Continued)

(56) References Cited

U.S. PATENT DOCUMENTS

| | | | |
|---|---|---|---|
| 38,732 | A | 6/1863 | Dick |
| 199,619 | A | 1/1878 | Corby |
| 431,395 | A | 7/1890 | Otto |

(Continued)

FOREIGN PATENT DOCUMENTS

| | | | |
|---|---|---|---|
| CN | 201378816 | Y | 1/2010 |
| CN | 201398842 | Y | 2/2010 |

(Continued)

OTHER PUBLICATIONS

"FR_2912205_A3_M—Machine Translation.pdf", Machine Translation, European Patent Office, Jan. 16, 2016.

*Primary Examiner* — Gregory Huson
*Assistant Examiner* — Daniel E Namay
(74) *Attorney, Agent, or Firm* — Christopher M. Ramsey; GrayRobinson, P.A.

(57) ABSTRACT

An example of the combustion engine includes a central chimney having a bottom end located adjacent a combustible fuel mixture of water and alcohol. A turbine has a top side with top side hole positioned around the chimney. A generally conical turbine insulator is positioned above the turbine and around the chimney. A generally conical deflector positioned above the insulator and around a top end of the chimney. The generally conical deflector is inverted relative to the generally conical turbine insulator.

19 Claims, 16 Drawing Sheets

(51) Int. Cl.
*F23K 5/10* (2006.01)
*F24C 5/18* (2006.01)

(58) Field of Classification Search
CPC ..... F23L 2700/001; F23L 7/10; F23L 7/005; F23L 7/00
USPC ..... 126/43, 350.1, 30, 37 R, 51, 50, 312
IPC ..... F24C 5/20,5/12, 5/18; F23C 7/00; F23D 5/04; F23L 17/10; F23K 5/10
See application file for complete search history.

(56) References Cited

U.S. PATENT DOCUMENTS

| | | | |
|---|---|---|---|
| 621,962 | A | 3/1899 | Denayrouze |
| 832,019 | A | 9/1906 | Kallsen |
| 914,134 | A | 3/1909 | Galitz |
| 1,176,172 | A | 3/1916 | Schleusselburg |
| 1,222,346 | A | 4/1917 | Adams |
| 1,300,594 | A | 4/1919 | Ferdon |
| 1,362,044 | A | 12/1920 | Reich |
| 1,554,866 | A | 9/1925 | Martin |
| 1,879,954 | A | 9/1932 | Arthur |
| 1,957,971 | A | 5/1934 | Martin |
| 2,065,265 | A | 12/1936 | Bock |
| 2,254,248 | A | 9/1941 | Stirlen |
| 2,383,488 | A | 8/1945 | Joy |
| 2,614,618 | A | 10/1952 | Chadwick |
| 2,637,377 | A | 5/1953 | Budlane |
| 2,721,608 | A | 10/1955 | Chinn |
| 2,893,713 | A | 7/1959 | Haltmeier |
| 3,165,102 | A | 1/1965 | Palmer |
| 3,267,833 | A | 8/1966 | Artis |
| 3,392,659 | A | 7/1968 | Rousey |
| 3,430,550 | A | 3/1969 | Smith et al. |
| 3,650,661 | A | 3/1972 | Laguinia |
| 3,703,166 | A | 11/1972 | White, Jr. |
| 3,782,303 | A | 1/1974 | Pfister et al. |
| 4,050,442 | A | 9/1977 | Seiverling |
| 4,279,589 | A | 7/1981 | Ohmukai et al. |
| 4,518,347 | A | 5/1985 | Sonetaka et al. |
| 4,569,656 | A | 2/1986 | Shimizu et al. |
| 4,641,571 | A | 2/1987 | Anderson et al. |
| 4,793,321 | A | 12/1988 | Rafford et al. |
| 4,972,823 | A | 11/1990 | Stadin |
| 5,006,498 | A | 4/1991 | Kim |
| 5,819,640 | A | 10/1998 | Cuomo et al. |
| 5,881,709 | A | 3/1999 | Daoust |
| 6,182,654 | B1 | 2/2001 | Jones |
| 6,347,936 | B1 | 2/2002 | Young et al. |
| 6,431,973 | B1 | 8/2002 | Tsung |
| 9,506,656 | B2 * | 11/2016 | Gravel ..... F24C 5/12 |
| 2006/0172245 | A1 | 8/2006 | Hu et al. |
| 2008/0155985 | A1 | 7/2008 | Labrador |
| 2009/0025703 | A1 | 1/2009 | Van Der Sluis |
| 2010/0083946 | A1 | 4/2010 | Cedar et al. |
| 2010/0154778 | A1 | 6/2010 | Sun |
| 2010/0243228 | A1 | 9/2010 | Price |
| 2011/0017200 | A1 | 1/2011 | Zwern |
| 2011/0017679 | A1 | 1/2011 | Zwern |
| 2011/0021133 | A1 | 1/2011 | Zwern |
| 2011/0021134 | A1 | 1/2011 | Zwern |
| 2012/0060819 | A1 | 3/2012 | Hunt et al. |
| 2012/0298053 | A1 | 11/2012 | DeGrazia et al. |

FOREIGN PATENT DOCUMENTS

| | | | |
|---|---|---|---|
| DE | 102009043341 | A1 | 9/2010 |
| EP | 0950857 | A1 | 10/1999 |
| EP | 2101110 | A1 | 9/2009 |
| FR | 2912205 | | 8/2008 |
| GB | 407553 | | 3/1934 |
| GB | 458994 | | 12/1936 |
| GB | 1147319 | | 4/1969 |
| GB | 2446163 | | 8/2008 |
| JP | 56133513 | | 10/1981 |
| JP | 5810631 | | 6/1983 |
| JP | 10141668 | | 5/1998 |
| RU | 2237217 | | 9/2004 |
| WO | 8804533 | | 6/1988 |
| WO | 2005054748 | A1 | 6/2005 |
| WO | 2007131378 | A1 | 11/2007 |

* cited by examiner

COMBUSTION ENGINE FOR BURNING A FUEL MIXTURE OF WATER AND ALCOHOL

CROSS-REFERENCE TO RELATED APPLICATION

This is a continuation of U.S. application Ser. No. 14/043,011, filed Oct. 1, 2013, which is hereby incorporated by reference in its entirety.

BACKGROUND OF THE INVENTION

1. Field of Invention

The invention relates to a portable stove that operates using a liquid fuel of alcohol and water that can be diluted to concentrations as low as 50% alcohol by volume.

2. Background of Invention

The present invention represents a novel liquid fuel stove. Conventional stoves do not operate properly or at all when the fuel mixture used in those stoves exceeds 20% water by volume. This is because when the fuel used by conventional liquid stoves contains 20% or greater water by volume the stove fails to generate enough heat to boil water or cook food. Presently there are no devices available that allow for the effective use of stove fuel containing greater than 20% water by volume.

However, the present invention allows the fuel to contain up to approximately 50% water by volume while still functioning as a stove, generating enough heat to boil water or cook food. The present invention is designed to generate efficient heat with a fuel mixture of approximately 40% water and 60% ethanol by volume, but is fully functional with alcohol fuels containing up to approximately 50% water by volume. Methanol may also be used as an addition to or as a substitute for the ethanol.

SUMMARY OF THE INVENTION

In accordance with one aspect of the invention, a cooking stove that operates with a liquid fuel containing alcohol and up to 50% water by volume is provided. The device may consist of a portable structure, a freestanding structure, or a structure that can be integrated into a domestic or commercial kitchen countertop. The device may contain a grill, one or more burners, a body, a fuel tank, a fuel filter, a fuel line, a fuel restrictor and a fuel valve.

DETAILED DESCRIPTION OF THE INVENTION

The device [10] is shown generally in FIGS. 1-6. The device [10] has a frame [12], a fuel tank [14] and an engine assembly [16]. As described below, the fuel tank [14] fits within the frame [12], and the engine assembly [16] is located within the frame [12]. In addition, a grill [18] may be placed on a top surface [20] of the frame [12] in a position above the engine assembly [16].

Figure 2:
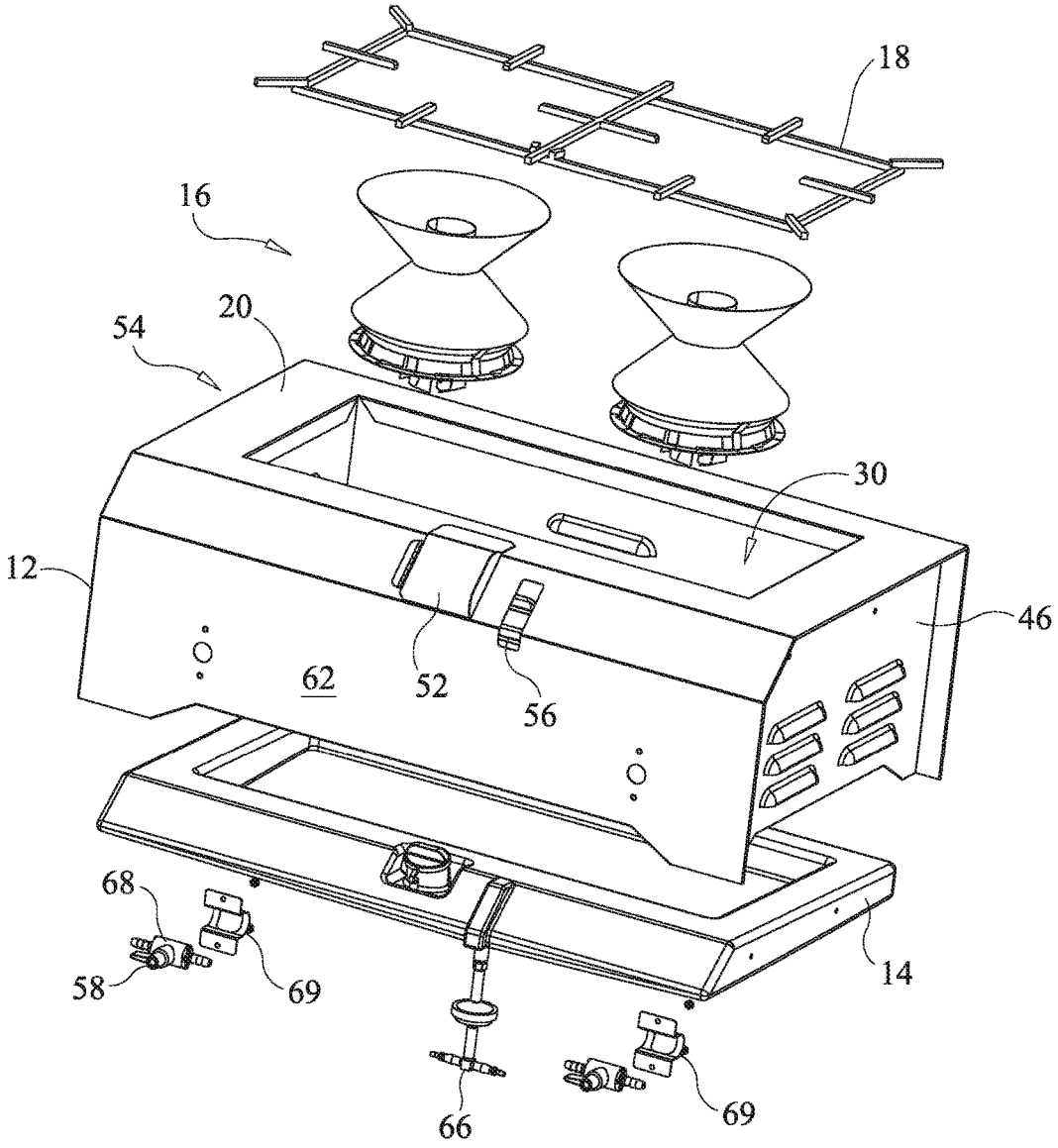
FIG. 2 is a perspective exploded view of the device.
Figure 3:
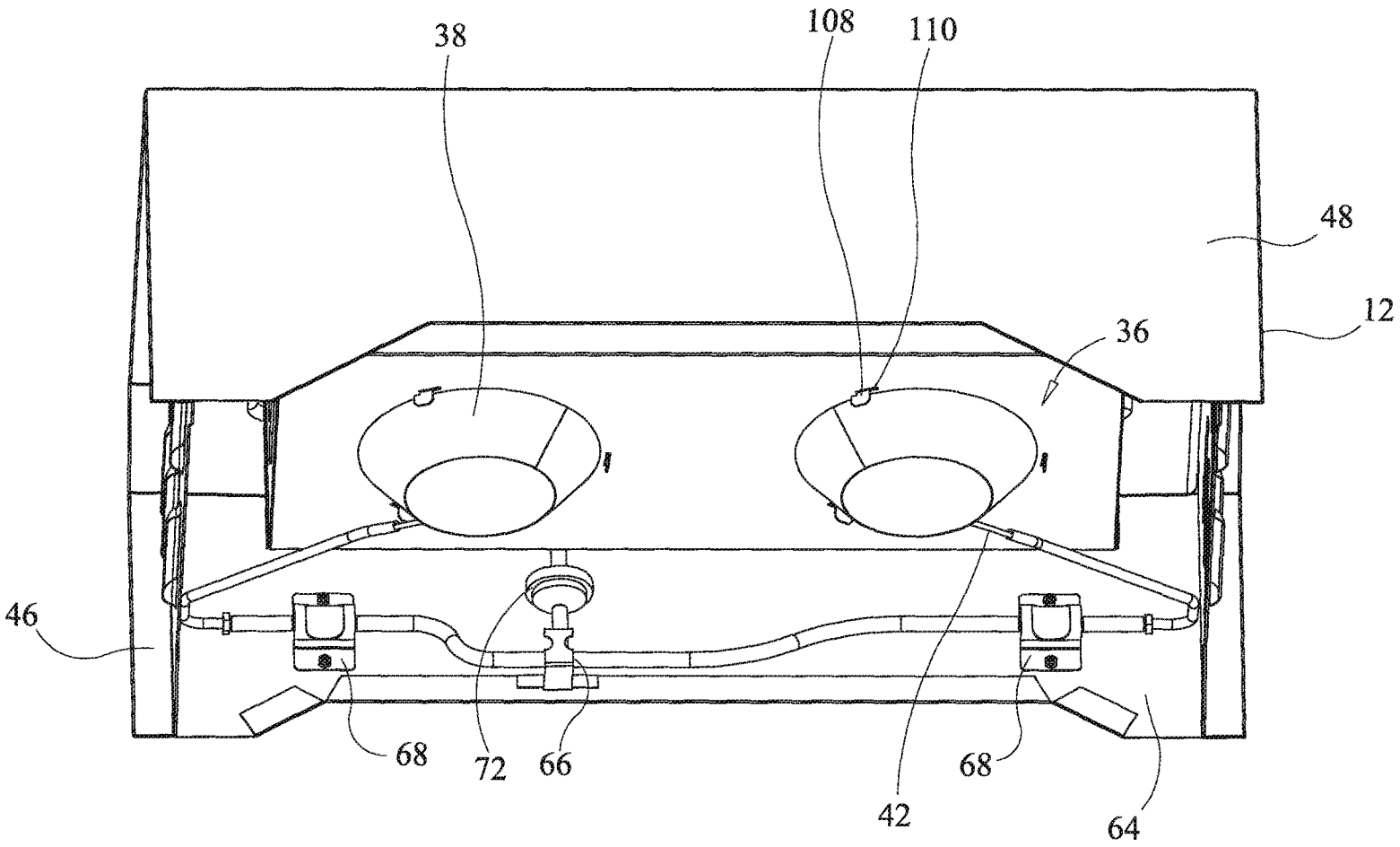
FIG. 3 is a bottom perspective view of the device.
Figure 4:
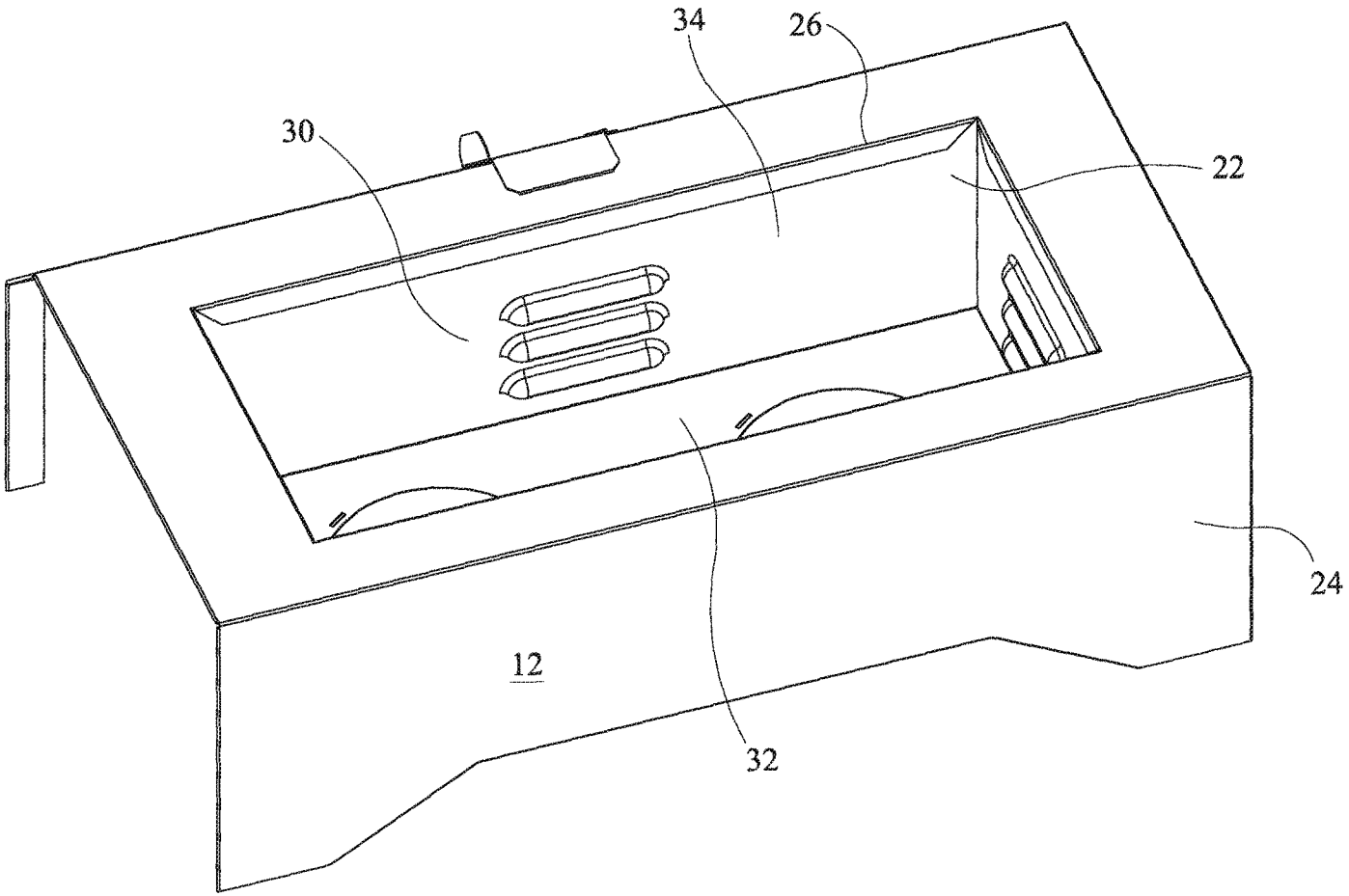
FIG. 4 is a top perspective view of the frame of the device.
Figure 5:
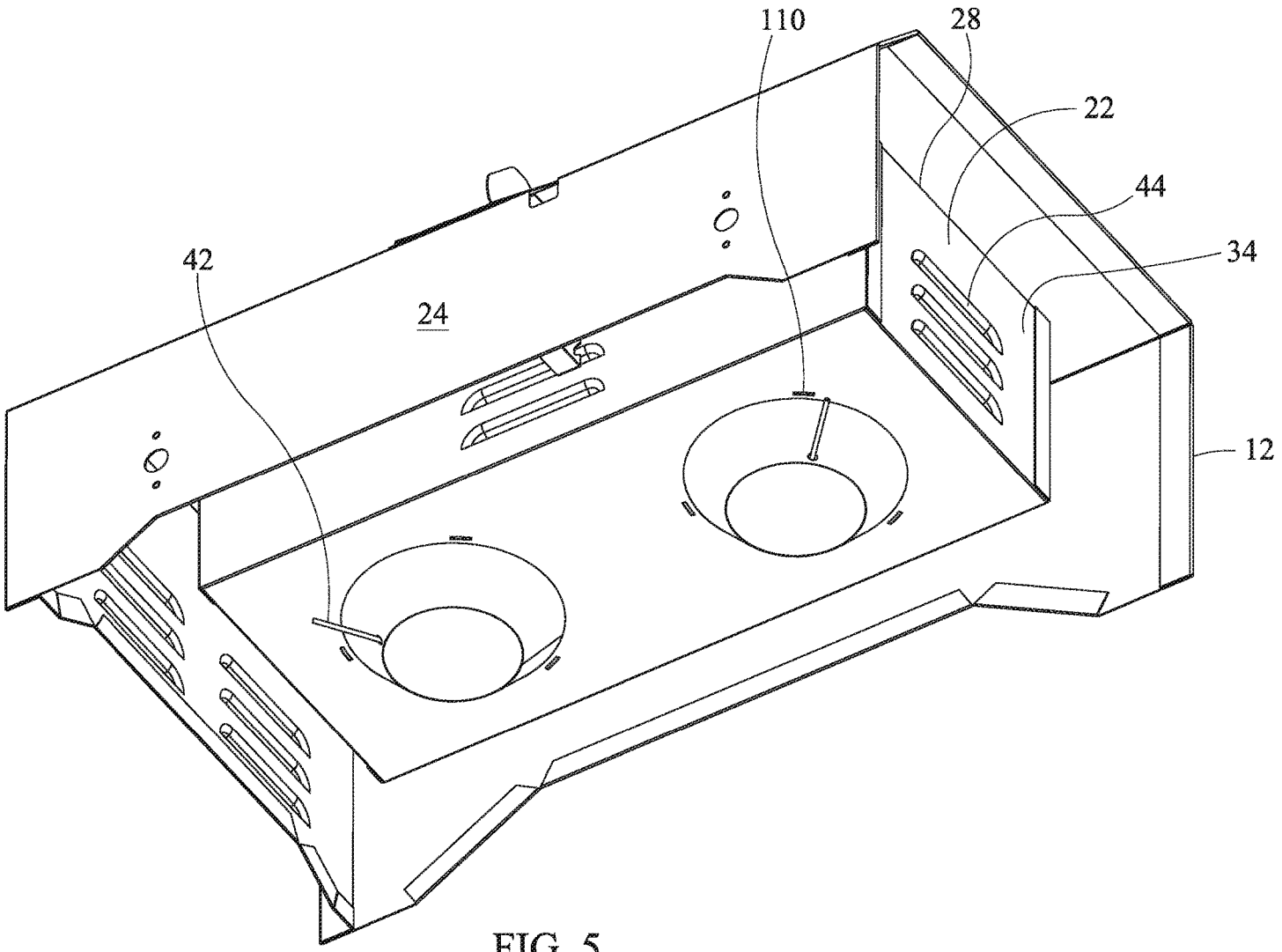
FIG. 5 is a bottom perspective cutaway view of the frame of the device.
Figure 6:
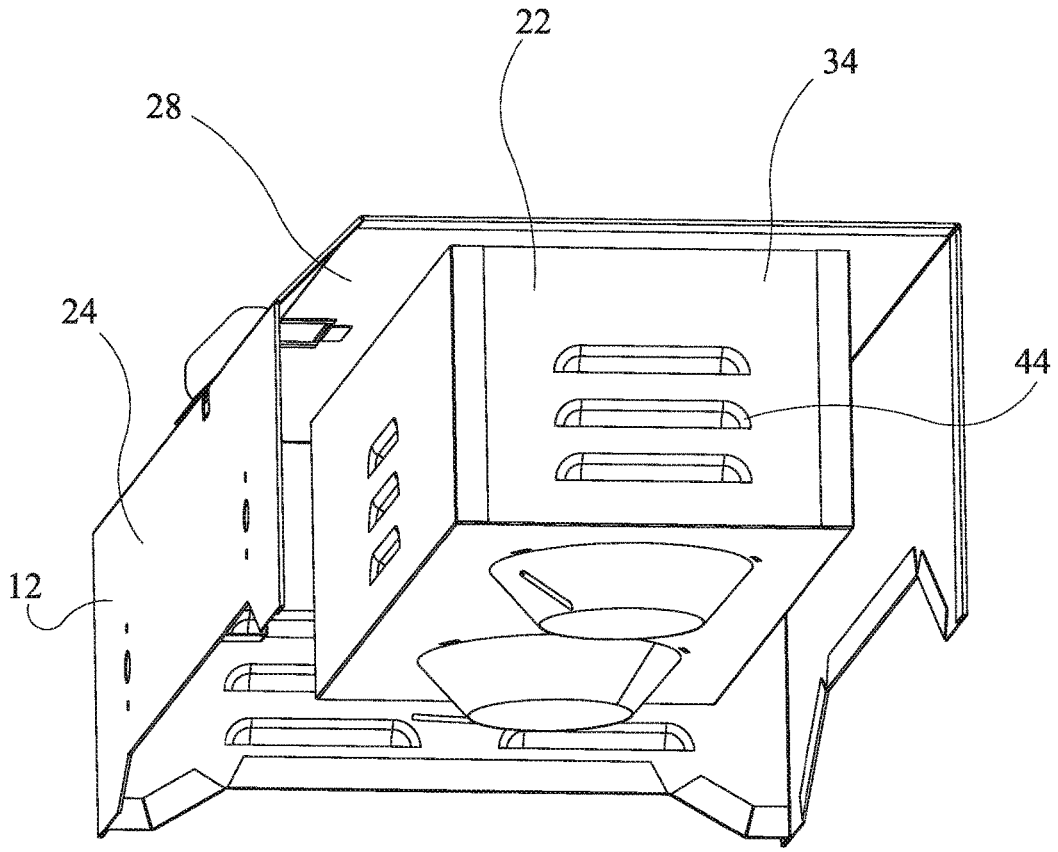
FIG. 6 is a side perspective cutaway view of the frame of the device.
Figure 7:
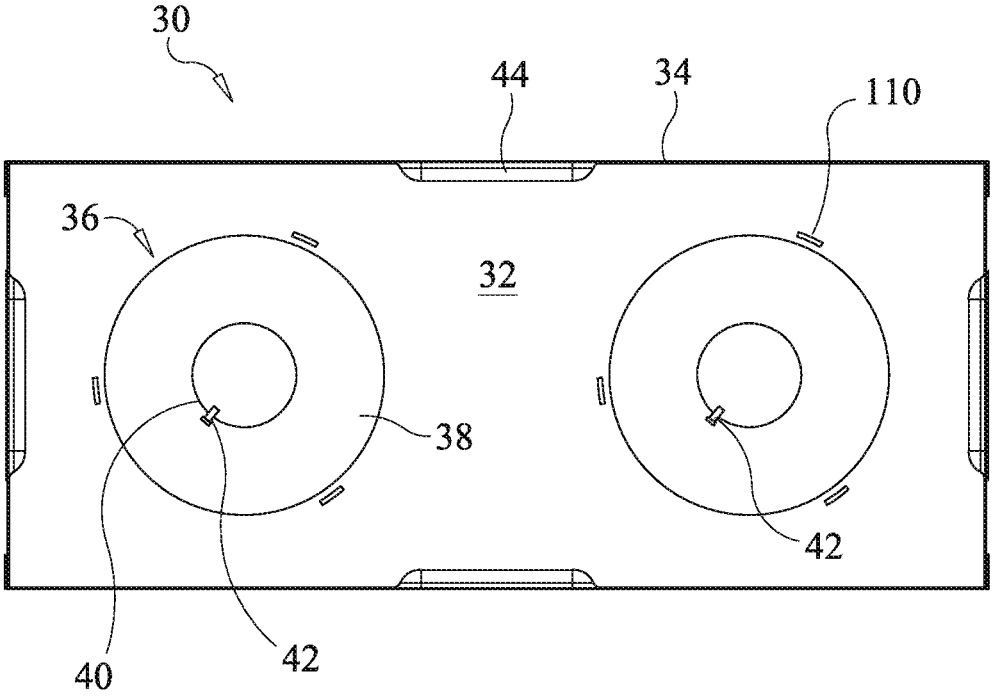
FIG. 7 is a top view of the inner portion of the frame.

The frame [ 12] is illustrated in FIGS. 1-7. As shown in FIGS. 4 and 5, the frame [12] includes an inner portion [22] and an outer portion [24]. The outer portion [24] includes a void [26]. The inner portion [22] includes a top edge [28] which is secured to the outer portion [24] at a perimeter of the void [26], thereby forming a recess [30] within the frame [12]. The void [26] and the top edge [28] are shown to be rectangular; however, other shapes, such as round, square and oval, are also contemplated. Other means for forming the recess [30] are also contemplated. The recess [30] has a recess bottom [32] and recess walls [34]. As shown in FIGS. 6 and 7, the recess bottom [32] includes one or more depressions [36] on the recess bottom [32]. The depressions [36] may have depression walls [38] which slope to a depression bottom [40]. One or more fuel distribution nozzles [42] may be attached to the frame [12] through the depression walls [38] to distribute fuel into the depression [36]. One or more fuel distribution nozzles [42] may be used for each depression [36].

The recess walls [34] may also include one or more vents [44]. The vents [44] may be on one or more recess walls [34], and one or more vents [44] may be on each recess wall [34] having a vent [44]. The vents [44] may be formed from the recess walls or they may be placed in holes made in the recess walls [34].

As shown in FIGS. 3 and 4, the outer portion [24] of the frame [12] also has frame outer portion side walls [46] and a frame outer portion back wall [48]. Outer frame vents [50] may be located on one or more of the frame outer portion side walls [46] or the frame outer portion back wall [48] or both.

Figure 1:
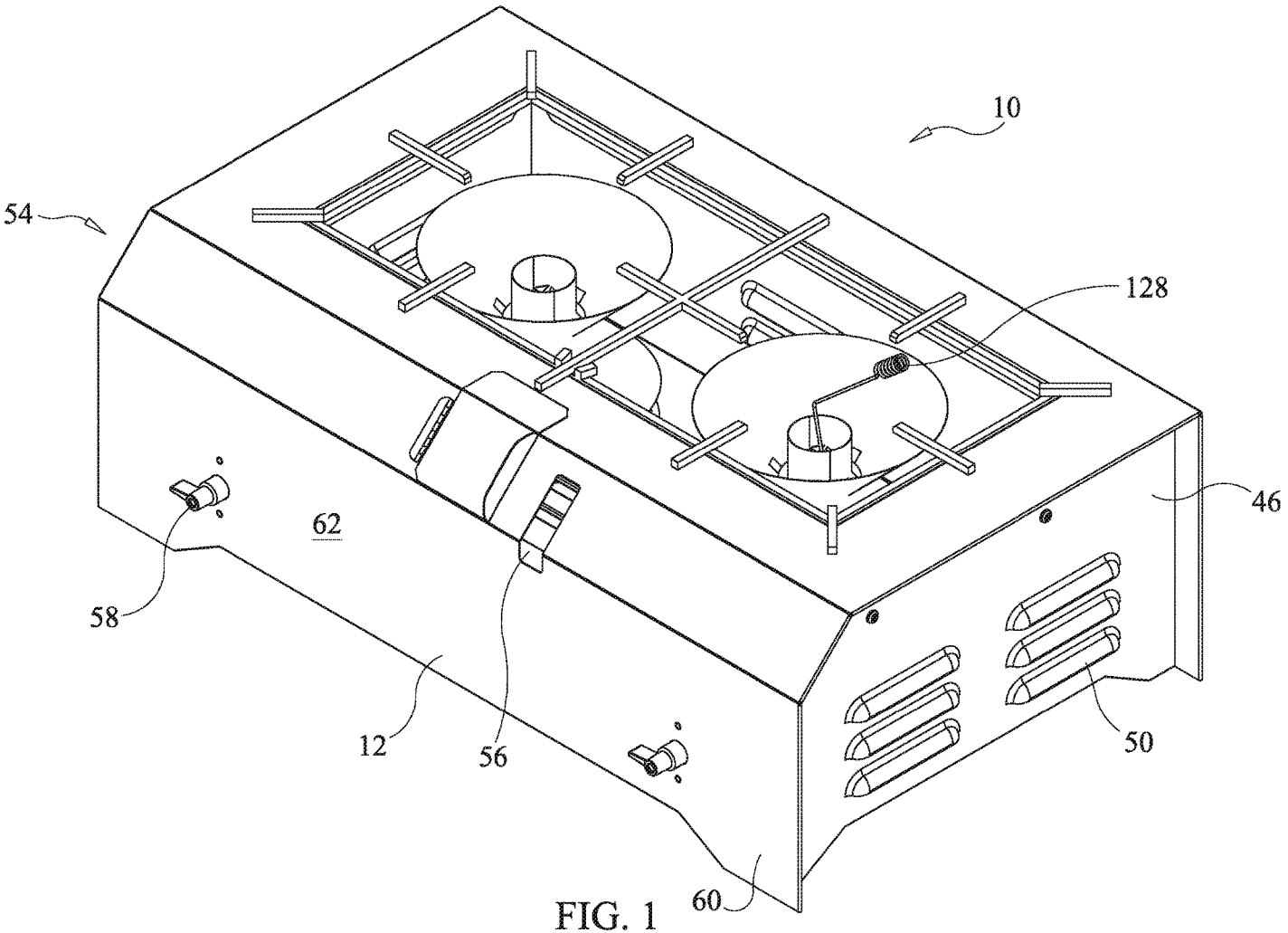
FIG. 1 is a perspective view of the device.

The outer portion [24] of the frame [12] may also include a fuel tank access door [52] located at a top end [54] of the outer portion of the frame [12]. As shown in FIGS. 1 and 2, a cutout [56] may be made near the top end [54] of the outer portion [24] of the frame [12] so that the amount of fuel in the fuel tank [14] may be observed. A transparent or translucent pane, with or without markings to show the level of fuel in the fuel tank [14], may be inserted in the cutout [56]. In addition, one or more fuel flow controls [58] may be placed upon the frame [12], and may be located on a front surface [60] of a control panel [62] on the outer portion [24] of the frame [12]. On the back surface [64] of the control panel [62] may be located a fuel distributor [66] and one or more fuel valves [68], The fuel valves [68] are accessible by the user and are in mechanical connection with the fuel flow controls [58] or restrictors and are controlled by the fuel flow controls [58]. The fuel distributor [66] and the fuel valves

[68] may be attached to the back surface [64] of the control panel [62] by one or more clamps [69] or by other equivalent means known in the art.

Figure 8:
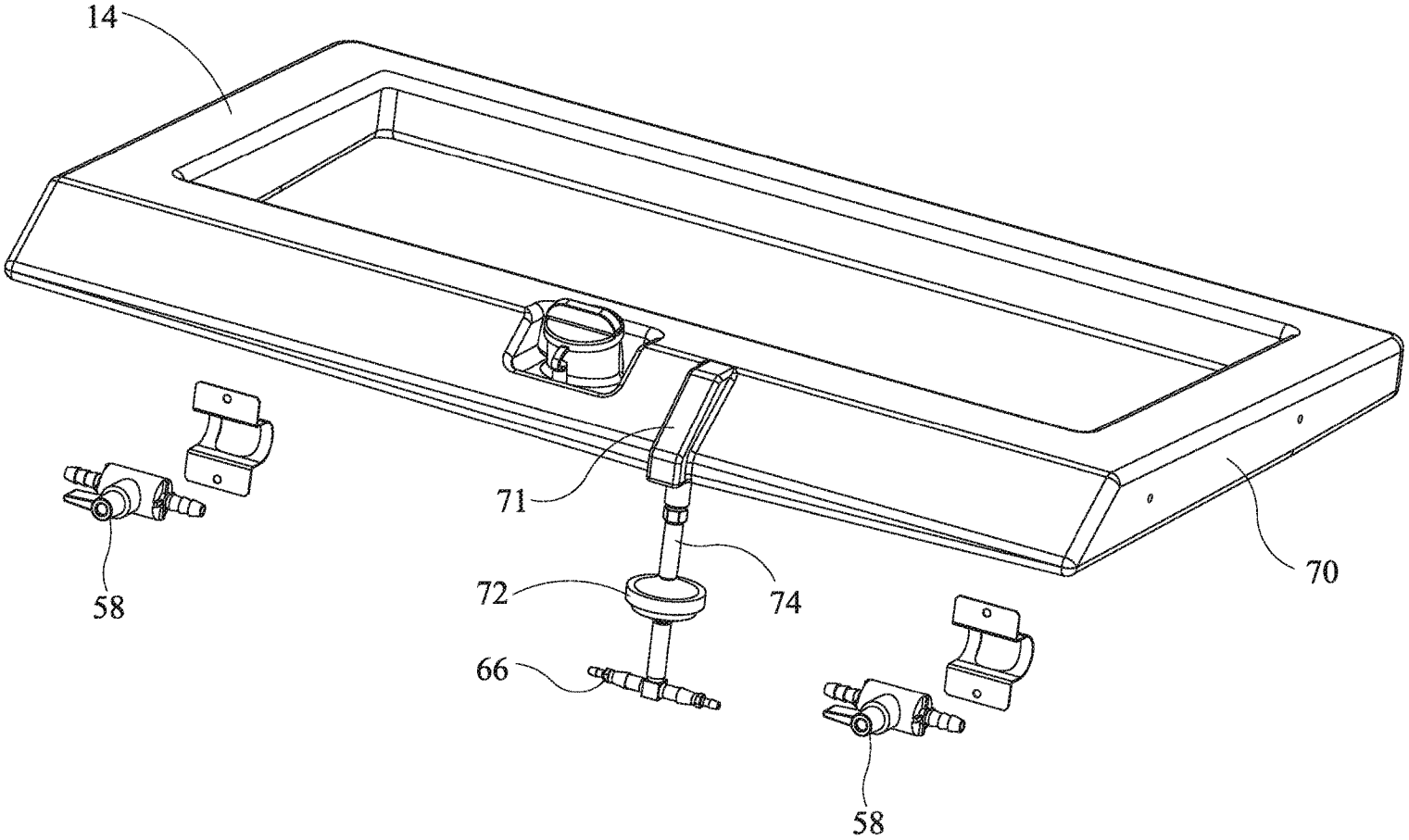
FIG. 8 is a perspective view of the fuel tank of the invention and portions of the fuel distribution system.
Figure 9:
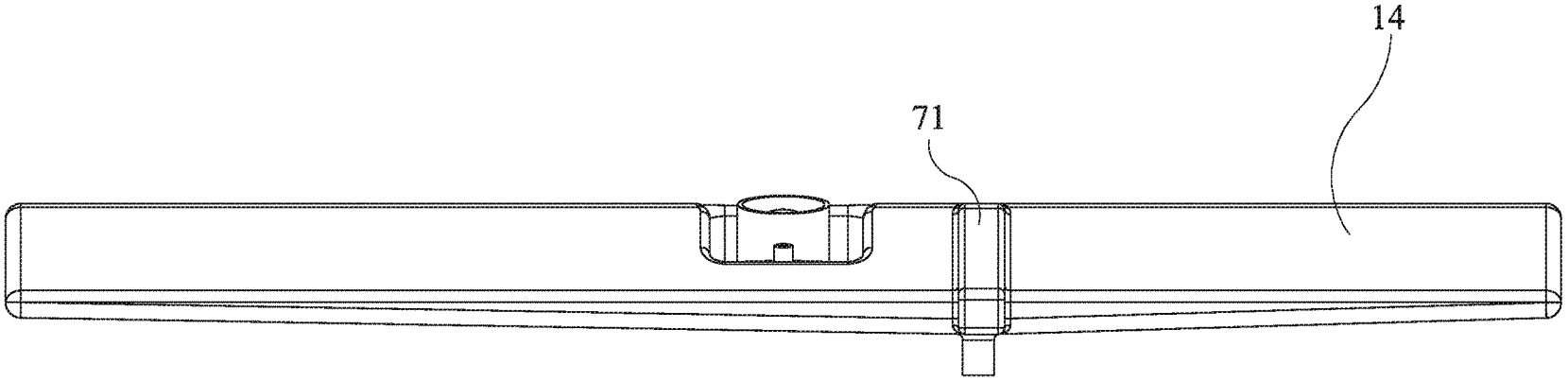
FIG. 9 is a front view of the fuel tank of the invention.

The fuel tank [14] is illustrated in detail in FIGS. 8 and 9. As shown in FIG. 2, the fuel tank [14] is shaped to fit within the frame [12] between the inner portion [22] and the outer portion [24] of the frame [12]. The fuel tank [14] may be annular as illustrated, or it may be of some other shape, such as C-shaped or have an elongated shape. The fuel tank [14] may be attached to the frame by friction or by securing clips or some other means known in the art. The fuel tank [14] may include projections [70] to help it stay secured to the interior of the frame [12]. The fuel tank [14] may also comprise a second projection [71] corresponding to a cutout in the outer frame so that the interior of the fuel tank [14] may be viewed while maintaining the profile of the frame [12].

A fuel filter [72] may be attached to the fuel tank [14] as shown in FIGS. 3 and 8, and may be attached to the fuel tank [14] by a fuel filter tube [74]. Alternatively, the fuel filter [72] may be attached directly to the fuel tank [14] at a point on the fuel tank [14] where fuel is filtered before flowing from the fuel tank [14]. The direct attachment may be made by a screw fitting with complementary threads between the fuel filter and the tank. Also, other means for connecting the fuel filter and the fuel tank are contemplated. The fuel distributor [66] may be attached to the open end of the fuel filter [72] so that filtered fuel is distributed to the fuel distribution nozzles [42] within the depressions [36] in the frame [12]. One or more fuel tank lines may connect the fuel tank [14] to one or more fuel distributors [66] through the fuel filter [72]. One or more fuel distribution lines distribute fuel from the fuel distributor [66] to one or more fuel valves [68], and one or more fuel outlet lines distribute fuel from the fuel valves [68] to the fuel distribution nozzles [42]. The flow of fuel may be from gravity or by means of a fuel pump.

Figure 10:
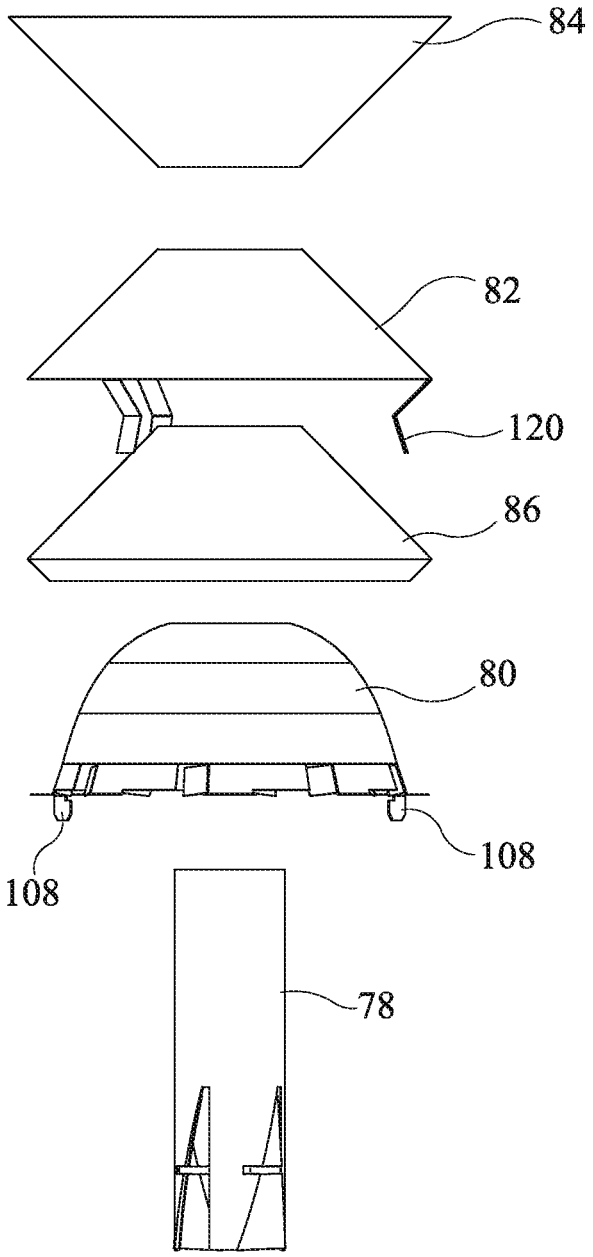
FIG. 10 is an exploded side view of the engine assembly of the invention.
Figure 11:
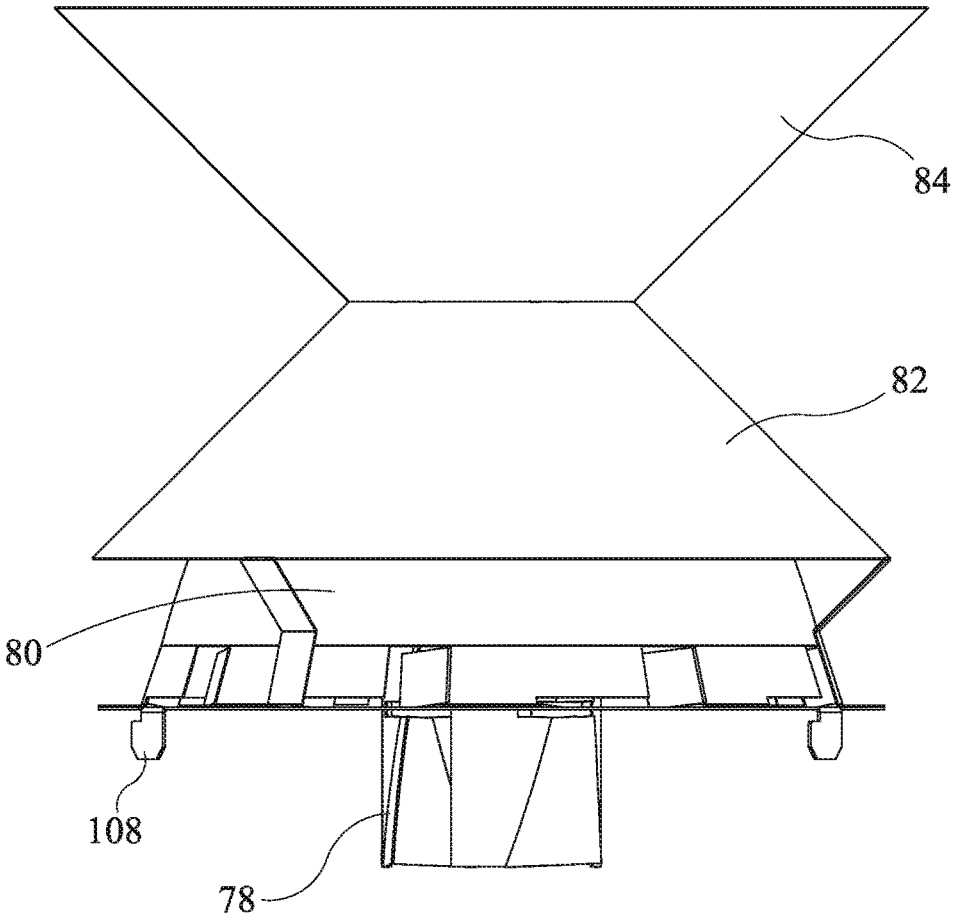
FIG. 11 is a side view of the engine assembly of the invention.

As shown in FIG. 2, located within the recess [30] is an engine assembly [16] for combustion of the fuel. The engine assembly is located within the depression [36] on the recess bottom [32]. As shown in FIGS. 10 and 11, the engine assembly [16] comprises a central chimney [78], a turbine [80], an insulator [82] and deflector [84]. There may also be an insulation blanket layer [86] between the turbine [80] and the insulator [82].

Figure 12:
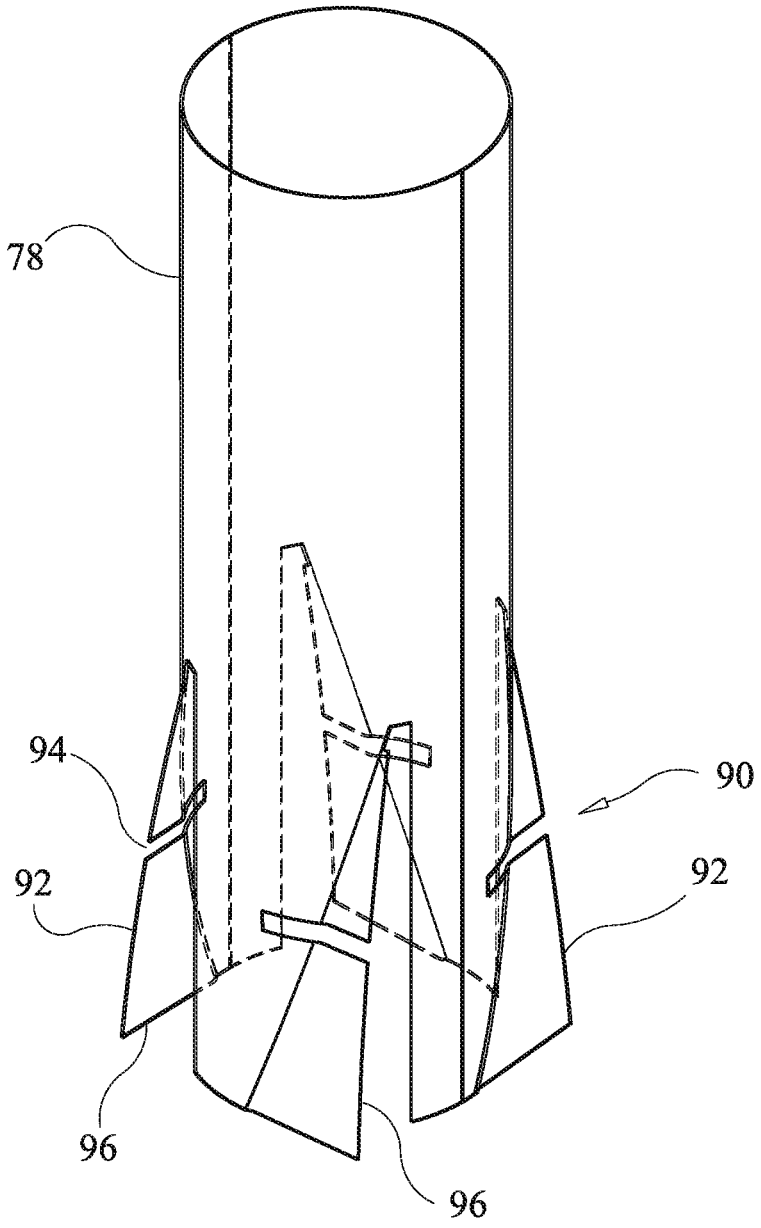
FIG. 12 is a perspective cutaway view of the chimney of the invention.
Figure 13:
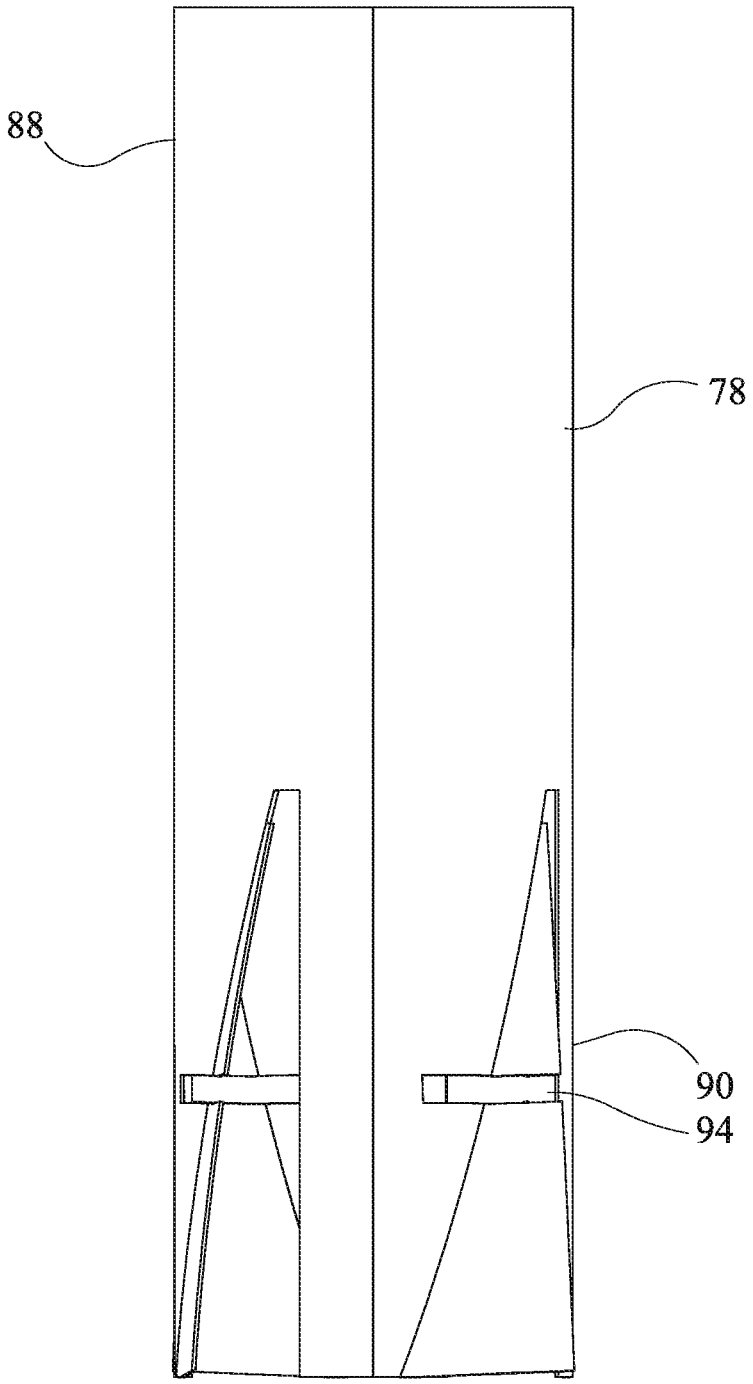
FIG. 13 is a side view of the chimney of the invention.

The chimney [78] is shown in FIGS. 12 and 13. The chimney [78] has a generally cylindrical shape having a top end [88] and a bottom end [90]. The bottom end [90] has at least one chimney fin [92] extending outward from a circumference of the chimney [78]. In addition, there may be one or more transverse cuts [94] located on the chimney fin [92] generally at a middle portion of the chimney fin [92]. The bottom end [90] of the chimney [78] also may include one or more vents [96] to allow air to flow into the chimney [78].

Figure 14:
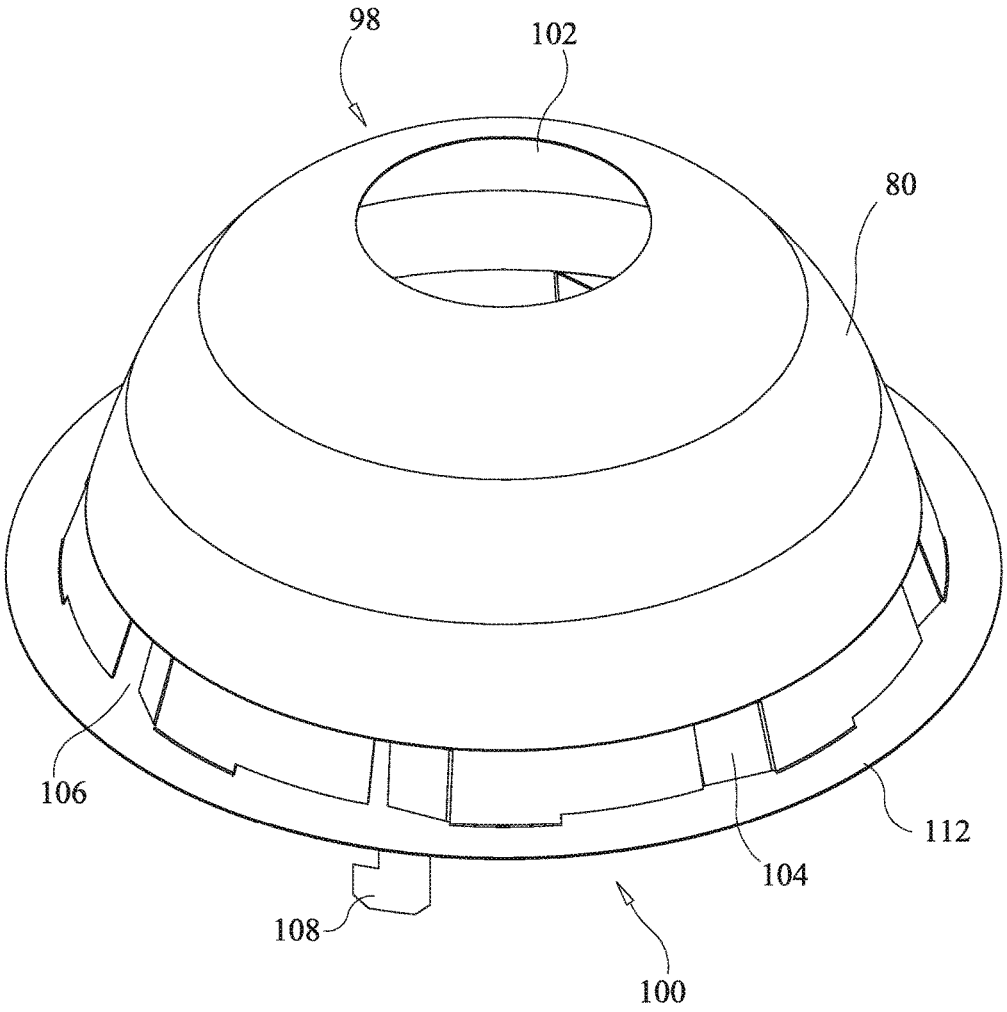
FIG. 14 is a perspective view of the turbine of the invention.

The turbine [80] is shown in FIG. 14. The turbine [80] has a top side [98] and a bottom side [100]. The top side [98] and the bottom side [100] of the turbine [80] are open. The turbine [80] has a top side hole [102] in the top side [98] in a size and shape complementary to the size and shape of the outside of the chimney [78] for receiving the chimney [78]. The turbine [80] may also have one or more turbine fins [104] and turbine slots [106] located at the bottom side [100] of the turbine [80]. A plurality of inward facing turbine fins [104] may be spaced around the bottom side [100] of the turbine [80], providing a passage for air from outside the turbine [80] to inside the turbine [80] through the turbine slots [106]. The bottom side [100] of the turbine [80] may also include a securing mechanism for attachment of the turbine [80] to the recess bottom [32]. One securing mechanism may be one or more J-lock tabs [108] and corresponding slits [110] in the recess bottom [32], as shown in FIGS. 3 and 7. Other means for securing the turbine [80] to the recess bottom [32] known in the art, such as a turbine depression in the recess bottom to allow a press fitting of the turbine onto the recess bottom [32], are also contemplated. In addition, the bottom side [100] of the turbine [80] may include a lip [112] to minimize air flow into the turbine [80] from anywhere other than the turbine slots [106]. The turbine [80] may be generally bowl shaped and may have the top side [98] with a smaller radius than the bottom side [100].

Figure 15:
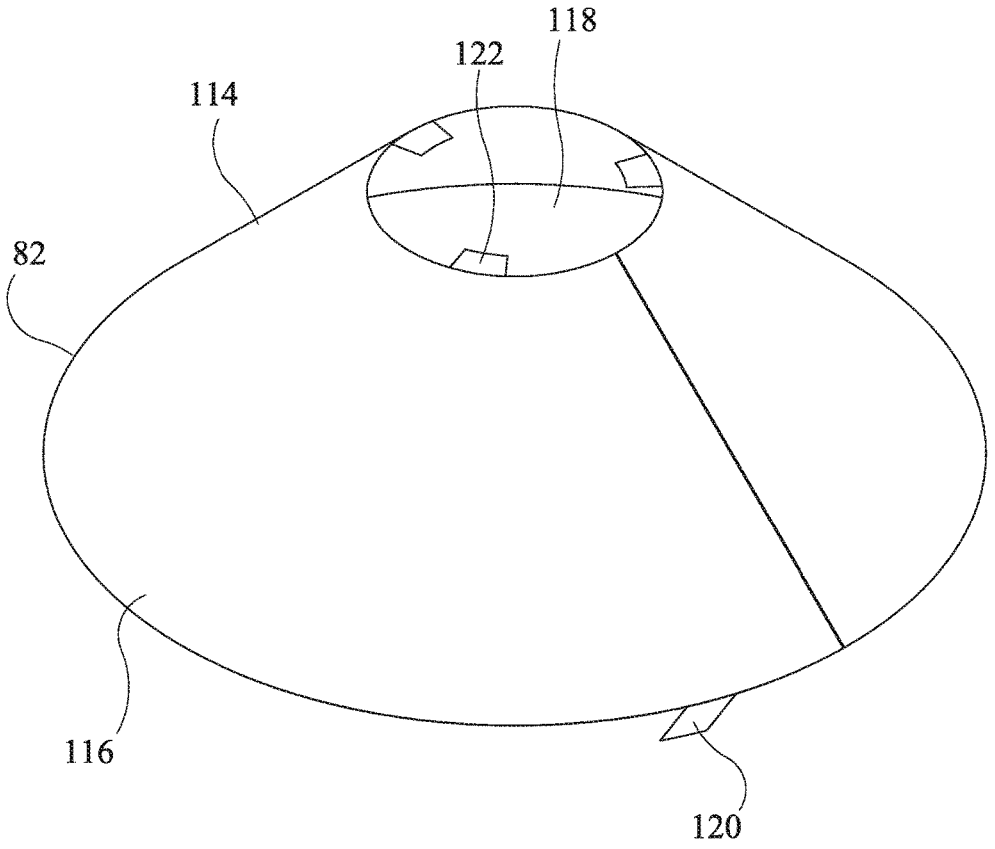
FIG. 15 is a perspective view of the insulator of the invention.

An insulator [82] is shown in FIG. 15. The insulator [82] may be generally conical in shape, and of a size so that it may fit over the turbine [80] during operation. The insulator [82] has an insulator top end [114] and an insulator bottom end [116]. Both ends are open. The insulator top end [114] has an opening [118] sized to allow the chimney [78] to pass through and extend above the insulator top end [114] during operation.

As shown in FIG. 15, the insulator [82] may include insulator bottom end tabs so that the insulator bottom end [116] may be mechanically connected to the bottom side [100] of the turbine [80] through having the bottom end tabs [120] placed in the turbine slots [106]. Other means for connecting the turbine [80] directly or indirectly with the insulator [82] are also contemplated. In addition, the insulator [82] may include insulator top end tabs [122] so that the top end [114] of the insulator [82] may attach to the bottom end of the deflector [84] as described below. Other means for connecting the deflector with the insulator are also contemplated.

Figure 16:
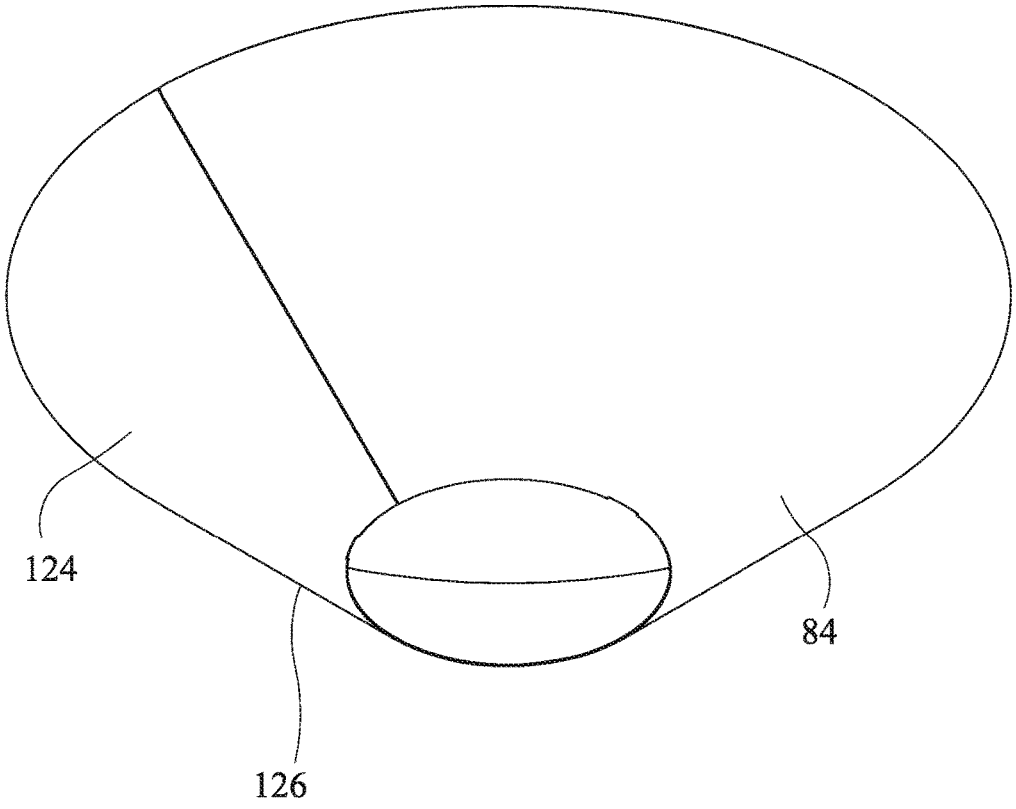
FIG. 16 is a perspective view of the deflector of the invention.

A deflector [84] is shown in FIG. 16. The deflector [84] is open at both ends and is generally conical in shape. The deflector [84] may be placed in inverted orientation with respect to the insulator [82], as shown in FIG. 10. The deflector [84] has a top portion [124] and a bottom portion [126]. The top portion of the chimney [88] that extends above the top portion of the turbine [98] and the top portion of the insulator [114] passes through an opening in the bottom portion of the deflector [126]. The bottom portion of the deflector [126] may be attached to the top portion of the insulator [114] by having the top end tabs [122] of the insulator [82] extend into the opening in the bottom portion of the deflector so that the deflector and the insulator are held together by friction. Other means for connection are also considered. Alternatively, the insulator and the deflector may be formed into a single piece.

In addition, as shown in FIG. 10 the insulation blanket layer [86] between the turbine [80] and the insulator [82] may also be conical in shape so it may fit between the turbine [80] and the insulator [82]. The insulation blanket layer [86] may be made from ceramic wool or an equivalent material to provide improved insulation.

In operation, the turbine, insulation, insulator, deflector, and chimney may be assembled prior to placement within the frame. These components may all also be secured in their respective orientations each with the other. Also, the stove may be made operational through the use of an extended lighter [128], as shown in FIG. 1.

The combustion engine assembly may be attached to the recess bottom through hooks, welding, or other means.

Alternatively, a fuel tank may be located outside the frame but otherwise connected to the fuel distribution system of the invention so that the stove may be operated.

Also, in operation, initial fuel may be placed in the bowl by opening the fuel control and allowing a predetermined amount of fuel to flow from the fuel tank to the depression. Alternatively, flowing fuel may be brought to the depression, and the user may ignite the fuel as it flows into the depression.

In another embodiment of the device, the device can be built into a countertop.

In yet another embodiment of the device, legs can be attached to the lower part of the body of the device to elevate the device for ease of use by the end user.

There has been described a new and useful stove, it is apparent that those skilled in the art may make numerous modifications and departures from the specific embodiments described herein without departing from the spirit and scope of the claimed invention.

The invention claimed is:

1. A combustion engine comprising:

a central chimney having a bottom end located adjacent a combustible fuel mixture of water and alcohol;

a turbine having a turbine top side with a top side hole through the turbine top side, the top side hole being positioned around the chimney;

a generally conical turbine insulator positioned above the turbine and around the chimney; and a generally conical deflector positioned above the insulator and around a top end of the chimney, the generally conical deflector being inverted relative to the generally conical turbine insulator.

2. The combustion engine of claim 1, wherein the central chimney includes at least one chimney slit located at the bottom end of the chimney and at least one chimney fin located at the bottom end of the chimney.

3. The combustion engine of claim 1, wherein the turbine includes a bottom side having at least one inward facing turbine fin and at least one turbine slit.

4. The combustion engine of claim 1, wherein the turbine has an inverted bowl shape.

5. The combustion engine of claim 1, wherein the deflector and the insulator are formed as a monolithic single piece.

6. The combustion engine of claim 1, wherein the chimney includes a cylindrical body that extends coaxially through the turbine, turbine insulator, and deflector.

7. The combustion engine of claim 1, wherein the turbine circumscribes the chimney.

8. The combustion engine of claim 1, wherein:

the chimney has a cylindrical chimney body defining a chimney interior that extends along a cylindrical axis from the bottom end to the top end, the bottom end includes a plurality of circumferentially spaced vents formed through the cylindrical chimney body for allowing air to flow into the chimney interior;

the turbine includes a hollow turbine body circumscribing the cylindrical chimney body and defining a turbine interior;

the turbine body extends coaxially with the cylindrical chimney body from an open turbine bottom side to the top side hole in such a way that the cylindrical chimney body passes through the open turbine bottom side and top side hole; and the turbine body includes a plurality of circumferentially spaced slits formed through the turbine body for allowing air to flow into the turbine body.

9. A combustion engine comprising:

a chimney having a cylindrical chimney body defining a chimney interior that extends along a cylindrical axis from an open chimney bottom end to an open chimney top end, the chimney bottom end including a plurality of circumferentially spaced vents formed through the cylindrical chimney body for allowing air to flow into the chimney interior;

a fuel source positioned adjacent to and beneath the chimney bottom end; and a hollow turbine body circumscribing the cylindrical chimney body and defining a turbine interior, the turbine body extending coaxially with the cylindrical chimney body from an open turbine bottom side to an open turbine top side in such a way that the cylindrical chimney body passes through the open turbine bottom side and open turbine top side, the turbine body including a plurality of circumferentially spaced slits formed through the turbine body for allowing air to flow into the turbine body.

10. The combustion engine of claim 9, further comprising a fuel tank including a fuel mixture of water and alcohol, the fuel tank being in fluid communication with the fuel source for providing fuel to the fuel source.

11. The combustion engine of claim 9, wherein the fuel source includes a mixture of water and alcohol and the mixture is at least 20% water.

12. The combustion engine of claim 9, wherein the turbine body is generally bowl shaped.

13. The combustion engine of claim 9, wherein the plurality of circumferentially spaced vents formed through the cylindrical chimney body extend into the turbine interior.

14. The combustion engine of claim 9, further comprising an insulator having a generally conical shape defining an insulator interior, the insulator being positioned over the turbine body, the insulator extending coaxially with the cylindrical chimney body from an open insulator bottom end to an open insulator top end in such a way that the cylindrical chimney body passes through the open insulator bottom end and open insulator top end.

15. A method of generating heat, the method comprising:

generating heat from a combustion engine comprising (a) a central chimney having a bottom end located adjacent a combustible fuel mixture of water and alcohol;

(b) a turbine having a turbine top side with top side hole through the turbine top side, the top side hole being positioned around the chimney;

(c) a generally conical turbine insulator positioned above the turbine and around the chimney; and (d) a generally conical deflector positioned above the insulator and around a top end of the chimney, the generally conical deflector being inverted relative to the generally conical turbine insulator by igniting the fuel mixture.

16. The method of claim 15, wherein the turbine has an inverted bowl shape.

17. The method of claim 15, wherein the deflector and the insulator are formed as a monolithic single piece.

18. The method of claim 15, wherein the chimney includes a cylindrical body that extends coaxially through the turbine, turbine insulator, and deflector.

19. The method of claim 15, wherein the turbine circumscribes the chimney.

* * * * *